United States Patent [19]

Caulkins

[11] Patent Number: 4,619,177

[45] Date of Patent: Oct. 28, 1986

[54] MUSICAL INSTRUMENT PNEUMATIC ACTUATOR

[76] Inventor: Kenneth B. Caulkins, 1320 Angie #C, Modesto, Calif. 95351

[21] Appl. No.: 728,937

[22] Filed: Apr. 30, 1985

[51] Int. Cl.[4] ..... G10F 1/02

[52] U.S. Cl. ..... 84/50; 84/53; 84/61

[58] Field of Search ..... 84/50, 53, 60–63, 84/67, 68

[56] References Cited

U.S. PATENT DOCUMENTS

| | | | |
|---|---|---|---|
| 913,867 | 3/1909 | Wuest, Jr. | 84/63 |
| 1,041,219 | 10/1912 | Wuest, Jr. | 84/63 |
| 1,208,138 | 12/1916 | Giuliana | 84/63 |
| 1,238,040 | 8/1917 | Maxwell | 84/61 |
| 1,298,113 | 3/1919 | Spencer | 84/53 |
| 1,325,912 | 12/1919 | Rogers | 84/63 |
| 1,423,505 | 7/1922 | Gustafson | 84/53 |
| 1,533,052 | 4/1925 | Wheatley | 84/53 |
| 1,681,338 | 8/1928 | Gulbransen | 84/62 |
| 3,033,068 | 5/1962 | Westfield | 84/53 |
| 4.145.947 | 3/1979 | Joy | 84/50 |

*Primary Examiner*—Benjamin R. Fuller

*Attorney, Agent, or Firm*—Kerkam, Stowell, Kondracki, & Clarke

[57] ABSTRACT

A musical instrument pneumatic actuator uses valve seats and a vacuum tube which are integral with one of two plastic main body pieces. An anti-warp brace and curved recessed portion are respectively used to minimize warpage and wear on the bellows. A beveled atmospheric port allows easy insertion of a valve piece.

21 Claims, 6 Drawing Figures

MUSICAL INSTRUMENT PNEUMATIC ACTUATOR

BACKGROUND OF THE INVENTION

This invention relates to pneumatic actuators for use with musical instruments. More particularly, this invention relates to such pneumatic actuators as used in player pianos or similar instruments.

The use of pneumatic actuators for various musical instruments is well known. Traditionally, a player piano uses a plurality of pneumatic actuators corresponding on a one-to-one basis with the piano keys. Each actuator is connected to a vacuum source and includes a bellows which closes when a signal tube senses a hole in a paper tape, the paper tape being programmed with the particular musical selection.

Although pneumatic actuators have been in use for a long period of time, there have been significant problems with the actuators. Complexity of construction and relatively high cost of manufacture have been among the most common problems. Other significant problems have been failure of the bellows cloth or material due to pinch-induced wear upon it. Requirements for numerous small parts have complicated the assembly of most prior art musical instrument pneumatic actuators.

With reference now to FIG. 1, a particular prior art pneumatic actuator 10 will be discussed in detail. In particular, the pneumatic actuator 10 is shown operatively connected to a piano key 12 of a player piano by way of a push rod 14 the actuator 10 is mounted upon a support rod 16 and secured by set screw 18. The support rod or bar 16 extends between two wooden blocks such as the single block 20 shown in FIG. 1. The pneumatic actuator 10 includes upper and lower aluminum body pieces 22 and 24 respectively. The upper and lower body pieces are pivotably connected together by a bellows cloth or material 26 which is glued in a sealing fashion along the side edges of parts 22 and 24 and the front edges (adjacent push rod 14) of those pieces. The bellows 26 is of course flexible material such that it will fold when the pieces 22 and 24 are brought together in the manner described below.

The upper body piece 22 includes a front portion 28 connected to a valve cover portion 30 by way of an offset portion 32. A felt or similar fabric cloth 34 covers an atmospheric port 36, which port is a hole in the valve cover portion 30 bounded by a circular upper valve seat 38 made of plastic. The upper body piece 22 further includes a vacuum chamber enclosing portion 40 having a vacuum port 42 surrounded by a lower valve seat 44 having an annular portion extending around the outside of port 42 and a rim portion disposed above the port 42 as shown. Seated upon the lower valve seat 44 is a valve member having a disk-like valving portion 46V attached to a stem portion 46S. The stem portion 46S is operable for up and down movement under the influence of a pouch 48 mounted on a platform 70. The pouch in turn is operable in known fashion based upon the pressure signal on signal tube 50, which signal tube is mounted upon a plastic piece 52 slid into an opening extending completely across the upper back portion of the vacuum chamber enclosing portion 40 and adhered thereto. The piece 52 further includes a vacuum tube 54 which is hollow and communicates with a round vacuum hole (not shown) to the interior of the vacuum chamber defined by vacuum chamber enclosing portion 40 and sealed on its sides by bellows 26 and its upper back portion by the plastic piece 52 itself.

The operation of the actuator 10 of FIG. 1 will now be described. In the position shown in FIG. 1, the signal tube 50 is closed off from the atmosphere as a tube (not shown) extends to a tracker bar (not shown) covered by the paper tape of a player piano. That is, the paper tape indicates that the note corresponding to that particular actuator should not be depressed. The vacuum chamber defined within the vacuum chamber enclosing portion 40 will be evacuated due to the connection of a vacuum pump to the vacuum tube 54. The valve portion 46V will be disposed upon the lower valve seat 44 such that the lower bellows chamber 56 and upper bellows chamber 58 will be at atmospheric pressure due to air passing through the filter or felt piece 34 and the atmospheric port 36. The push rod 14 will be disposed in the position shown with a rubber piece 60 trapped within a groove on the upper front side of the lower body piece 24 simply resting against the push rod 14. When the signal tube 50 is opened to the atmosphere by way of the player piano paper tape having a slot indicating that the note corresponding to this actuator should be played, air flows into the signal tube 50 pushing up on the pouch 48 which in turn displaces upwardly the valve stem 46S and the integral valve portion 46V such that the valve portion 46V now is resting up against the upper valve seat 38. The vacuum pump (not shown) connected to the vacuum chamber by way of vacuum tube 54 is now in communication with the lower and upper bellows chambers 56 and 58 by way of the vacuum port 42. As the air is drawn out of the lower and upper bellows chambers 56 and 58, the bellows cloth 56 folds together and brings the lower body piece 24 up essentially adjacent to the upper body piece 22 along the length thereof. This upward movement of the lower body piece 24 (clockwise movement relative to a pivot point at the far right end of lower body piece 24) will cause the rubber piece 60 mounted within the aluminum lower body piece 24 to push up on the rod 14. This in turn lifts the back of the piano key 12 bringing the front of the key downward by virtue of the fulcrum (not shown).

Although the prior art actuator of FIG. 1 has been generally useful, the bellows material 26 has had a tendency to wear quickly. Specifically, breaks in the bellows material often occur. Additionally, the assembly of the separate plastic valve seats 36 and 44 within the aluminum upper body piece 22 as well as the assembly of the separate plastic piece 52 within the upper body piece 22 has been time consuming and difficult to accomplish. Further, after repeated use of the device there has been a tendency of the upper body piece 22 to warp or distort which may place added strain upon the bellows piece 26. The assembly of the valve member having portions 46V and 46S requires the drilling of a hole in the valve cover portion 30, which hole is larger than the diameter of the disk-like portion 46V. A corresponding hole also must be drilled in the vacuum chamber enclosing portion 40, the latter hole being just below the first mentioned hole. The lower valve seat 44 must then be placed within the hole after it has been sufficiently deburred. The valve would then be inserted. In order to capture the valve and provide a proper valve seat, the ring-like upper valve seat 38 must then be placed in the hole which was drilled in the valve cover portion 30. The signal tube 50 extends through a hole in the plastic piece 52 and into a platform which communicates with a zone underneath the pouch 42, and proper alignment of these holes is quite difficult. Finally, the use of glue to attach the bellows piece 26 to the upper and lower body pieces 22 and 24 often causes problems due to run off of excess glue.

OBJECTS AND SUMMARY OF THE INVENTION

Accordingly, a primary object of the present invention is to provide a new and improved musical instrument pneumatic actuator.

A more specific object of the present invention is to provide a musical instrument pneumatic actuator which is relatively low in cost, easy to assemble and having fewer parts.

A further object of the present invention is to provide a musical instrument pneumatic actuator whereby the bellows will have less of a tendency to wear out.

Yet another object of the present invention is to provide a musical instrument pneumatic actuator which resists warping under repeated use.

The above and other objects of the present invention which will become more apparent as the description proceed are realized by an invention comprising a musical instrument pneumatic actuator having: a plastic upper body piece including a front portion, an offset portion, a valve cover portion with an atmospheric port surrounded by an upper valve seat, the valve cover portion connected to and offset from the front portion by the offset portion, a valve chamber enclosing portion connected to the valve cover portion and having a vacuum port surrounded by a lower valve seat, a vacuum hole, and a signal hole; a valve member with a valve portion and a stem portion, the valve portion disposed between the upper valve seat and the lower valve seat for alternate seating thereon, the stem portion extending through the vacuum port; a pouch in the vacuum chamber enclosing portion and operable for moving the valve member; a lower body piece; and a bellows piece attaching the upper body piece to the lower piece for relative pivotable movement therebetween. The upper body piece is integral such that the upper valve seat and the lower valve seat are integral with each other. The valve portion has a larger upper surface area than the atmospheric port, the atmospheric port having boundaries which are integral with the upper body piece. The actuator includes a brace extending between the offset portion and the vacuum chamber enclosing portion. The lower body piece includes a recessed upper surface portion immediately adjacent a pivot point end of the lower body piece. The atmospheric port is beveled from a relatively wide top to a narrower bottom. The actuator further includes a vacuum tube integral with the upper body piece and with an interior having the vacuum hole. The bellows seals two sides of the vacuum chamber enclosing portion. The invention further comprises a plurality of the actuators operably connected to a musical instrument. The musical instrument is preferably a player piano. The lower body piece is made of plastic. The bellows material is attached to the upper and lower body pieces without glue by the use of solvent along the edges of the upper and lower body pieces.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 2A:
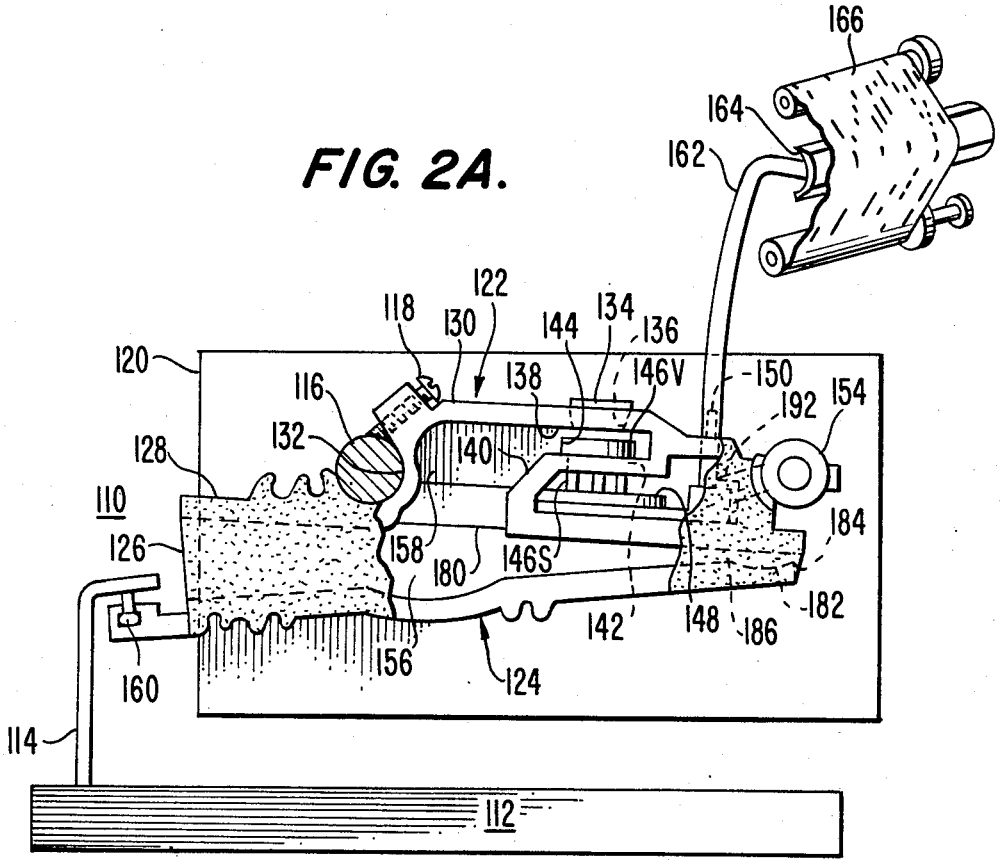
FIG. 2A shows a side view of the present pneumatic actuator with some parts broken away and illustrating attachments thereto.
Figure 2B:
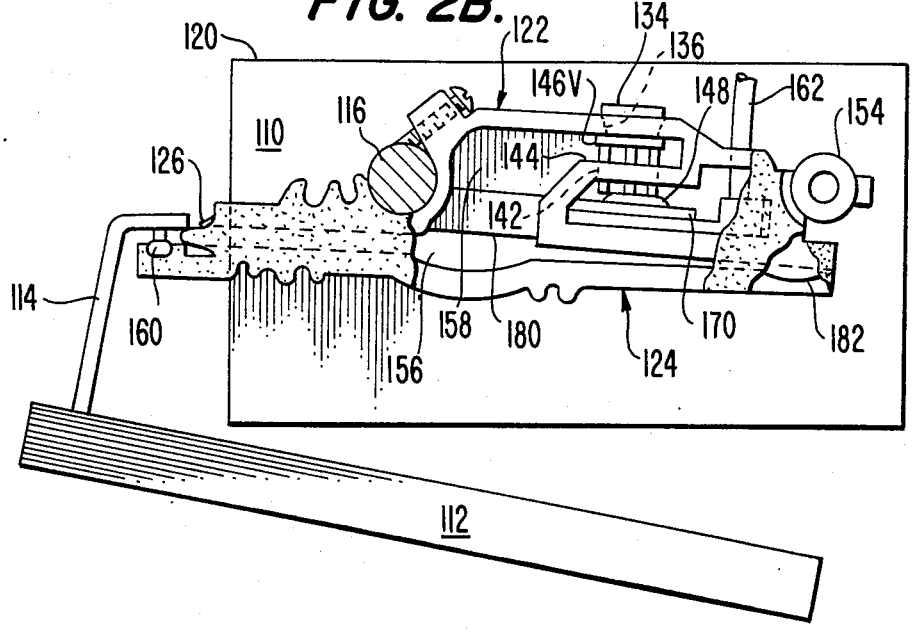
FIG. 2B shows the side view of the present pneumatic actuator when disposed in a compressed or actuation position.
Figure 3:
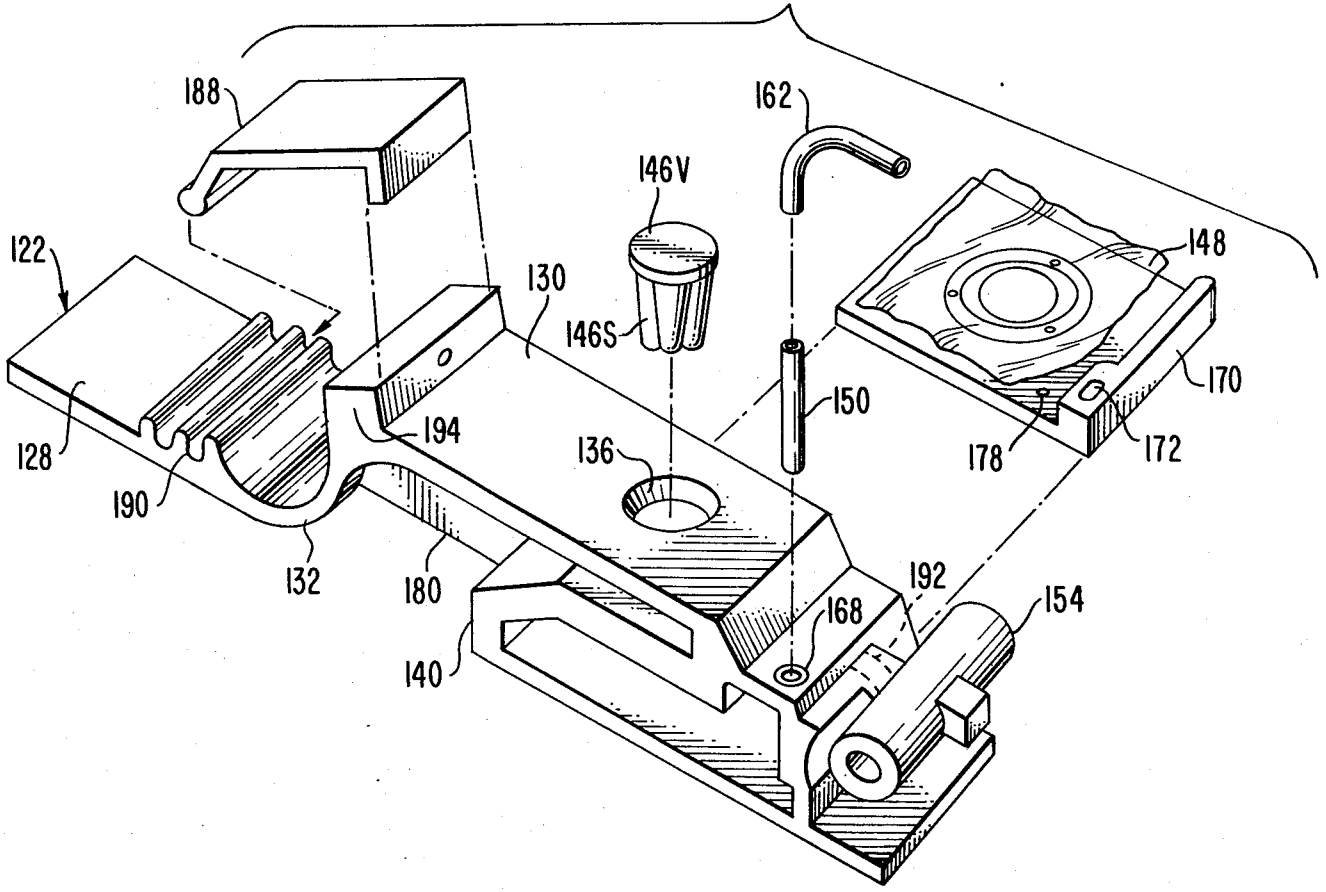
FIG. 3 shows an exploded view of several of the parts of the present pneumatic actuator.

The pneumatic actuator 110 of the present invention will be described in detail with reference to FIGS. 2A, 2B, and 3. FIG. 2A shows a side view with parts broken away of the actuator 110 in its expanded or rest position, whereas FIG. 2B shows the same essential view with the actuator 110 in its compressed or actuation position. FIG. 3 shows an exploded perspective view of numerous of the parts of an upper body piece 122.

Figure 1:
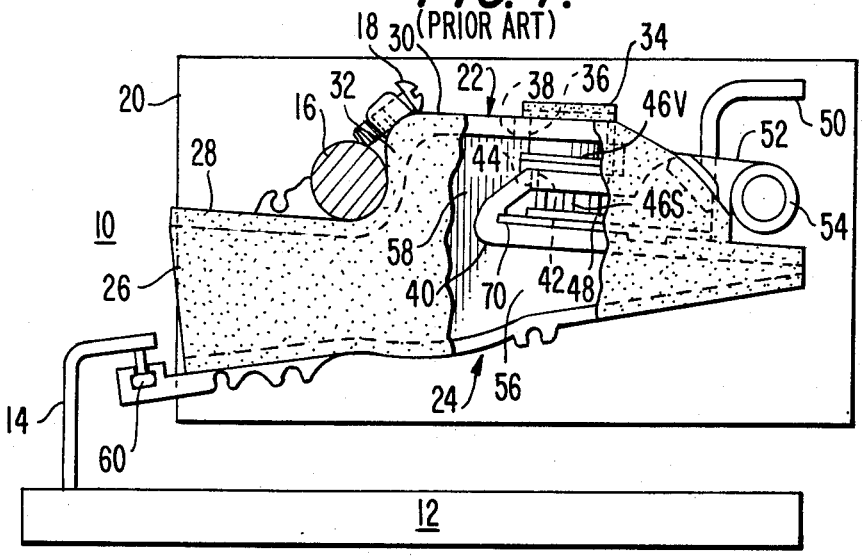
FIG. 1. (PRIOR ART)
FIG. 1 shows the prior art musical instrument pneumatic actuator discussed above.

As the basics of structure and operation of the improved pneumatic actuator 110 of the present invention are similar to that of the actuator 10, emphasis herein will be on the differences of the present invention. Further, the parts of the invention are labeled with the same last two digits as the similar part (if any) of the prior art embodiment of FIG. 1.

The pneumatic actuator 110 includes an upper body piece 122 and a lower body piece 124, both of which are made of plastic. The upper body piece 122 includes a front portion 128, an offset portion 132, a valve cover portion 130, a vacuum chamber enclosing portion 140, and a vacuum tube 154. All of these pieces are integrally part of the upper body piece 122. As shown, the vacuum enclosing portion 140 extends in a complete closed loop and includes the vacuum tube 154 integrally therewith. Further, a upper valve seat 138 surrounding an atmospheric port 136 and a lower valve seat 144 surrounding a vacuum port 142 are, unlike the arrangement of FIG. 1, integrally part of the upper body piece 122. In other words, there is no separate ring or disk type valve seat which must be applied into drilled holes as with the aluminum actuator of FIG. 1. Instead, the plastic of upper body piece 122 together with the taper of the atmospheric port 136 such that it is narrower at its bottom than at its top allows one to insert the resilient rubber valve member including valve portion 146V and valve stem 136S through the atmospheric port 136 even though the atmospheric port has a smaller surface area than the upper surface area of the valve portion 146V. In other words, the resilience of the valve portion 146V allows it to bend back under the taper of port 136 such that it may be compressed for insertion through port 136 and into the position shown in FIG. 2A. Not only do the premolded holes or ports 136 and 142 avoid the drilling as with the aluminum arrangement, but there is no need for reducing the diameter of the atmospheric port after insertion of the valve as was the case in the prior art model. In order to minimize the warpage and distortion which might otherwise lead to premature failure of the bellows 126, a brace 180 extends between the offset portion 132 and the vacuum chamber enclosing portion 140. The brace is also integral with the other portions of upper body piece 122.

The plastic upper body piece 22 does not have to be tapped to accomodate the wood screw 118, thereby simplifying the assembly.

One end of the vacuum tube 154 may be connected by hose (not shown) to a vacuum pump (not shown), whereas the other end may be connected by hose to a vacuum tube of an adjacent actuator. The two-ended feature of the vacuum tube 154 allows easily connection of numerous actuators in a row. A plug could be used on one end of the tube 154 if another actuator is not adjacent to it.

The bellows 126, one side of which is shown broken away, is not glued to the side edges of the upper and lower body pieces 122 and 124. Instead, the problem of excess glue has been avoided by use of a solvent such as alcohol upon the edges of the plastic pieces 122 and 124. The bellows piece may then be applied against the edge of the plastic and will adhere thereto in a satisfactory manner. The bellows of course seals off the vacuum chamber within the vacuum chamber enclosing portion 140 from the lower and upper bellows chambers 156 and 158 which freely communicate with each other past the centrally located brace 180. In order to minimize wear upon the bellows piece 126, curved recessed portion 182 is disposed at the pivot point end (i.e., where the lower piece 124 pivots relative to upper body piece 122) of the lower body piece 124. One of the problems in causing premature failure of the bellows 126 has been that the fabric is pinched in between the upper body piece 122 and the lower body piece 124. This pinching is most severe at the pivot point end (right end in FIG. 2A) where the pieces 122 and 124 are brought closest together, this being shown in the compressed state for the actuator 110 illustrated by FIG. 2B. The recessed portion 182 preferably extends from a pivot point axis tip 184 a distance of 3/16 of an inch to its edge at 186. The recessed portion 182 serves as a pocket allowing more space for the compressed bellows material 126, thus minimizing or preventing the harmful pinching of the bellows 126.

Figure 4:
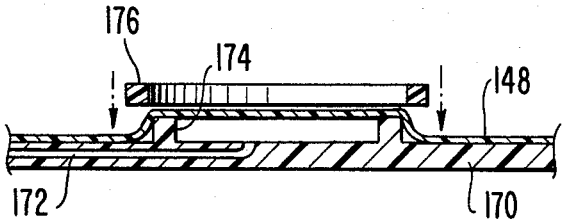
FIG. 4 shows a cross-section side view of a pouch and associated platform as used with the present invention.

The signal tube 150 is connected to a hose 162 extending to a tracker bar 164 which "reads" the music off a paper tape 166. As best shown in FIG. 3, the signal tube 150 may be a copper tube inserted into the plastic piece 122 at the signal hole 168. Prior to insertion of the signal tube 150, the pouch 148 and its associated platform 170 will have been inserted into the vacuum chamber defined by enclosing portion 140. The platform 170 includes a channel 172 which, with reference to the cross-section view of FIG. 4, extends down to beneath the pouch 148. The pouch 148 is secured without glue to the platform 170 by pushing down a holding ring 176. A bleed hole 178 (FIG. 3 only) could be disposed in the channel 172. A vacuum hole 192 extends from the hollow interior of the vacuum tube 154 into the vacuum chamber within portion 140. As this vacuum hole 192 is molded out of the plastic and is integral with the upper body piece 122, it may be rectangular or square for better communication with the vacuum chamber than with the previous round vacuum holes.

An optional slide on holder 188 (FIG. 3 only) may be used to hold the actuator onto a mounting bar, the holder having one edge snapped or slid into a groove 190 and the other edge on the back side of a projecting portion 194 of the upper body piece 122. The grooves other than 190 which are shown for the upper and lower body pieces 122 and 124 respectively may be used for attaching accessories in somewhat similar fashion to the grooves of the prior art FIG. 1 actuator. However, the accessories, such as a reiterating attachment, may be more easily attached in view of the plastic material of the pieces 122 and 124. Specifically, such attachments may be snapped into place more readily than the sliding into place required with the aluminum pieces of the prior art FIG. 1 design.

The operation of the present invention is relatively straight forward. The normally vacuum chamber within enclosed portion 140 is normally sealed from the atmosphere pressure of upper and lower bellows chambers 158 and 156. Upon air being received through the signal tube 150, this air travels through channel 172 and to below the pouch 148, thereby pushing it up as shown in FIG. 2B. The upward bulging in pouch 148 pushes the valve portion 146V against its upper valve seat closing the atmospheric port 136 and opening the vacuum port 142. The vacuum pump (not shown) connected to vacuum tube 154 removes the air from the lower and upper bellows chambers 156 and 158 thereby compressing the bellows 126 and bringing the lower body piece 124 closer to the upper body piece 122. This actuates the piano key 112 as shown in FIG. 2B. When the air has stopped flowing through tube 162, the pouch 148 drops back to its lower position, thus allowing valve portion 146V to drop back to its lower valve seat 144. The atmospheric port 136 is thus opened and air passes through the filter 134 into the upper and lower bellows chambers 156 and 158 such that the bellows 126 again assumes the position of FIG. 2A. If the actuators 110 are oriented in the position of FIG. 2A, gravity may be used to help the return of lower body piece 124 to its normal position. Alternately, a return spring may be mounted within the lower bellows chamber 156 (for example, just below the mount rod 116), the spring biasing the pieces 124 and 122 apart.

Figure 5:
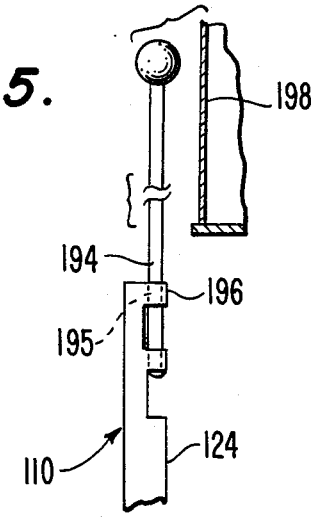
FIG. 5 shows a portion of the present actuator connected for operating a drum.

With reference now to FIG. 5, the pneumatic actuator 110 is shown partially and with a beater bar connected thereto. In particular, the beater bar 194 may extend through a hole 195 in the ridge 196 on the upper front end of the lower body piece 124. The beater bar 194, which is glued or otherwise fixed in position, may be used for actuating a drum 198. Alternately, such an arrangement may be used for actuating a tambourine, xylophone, or any of numerous other musical instruments.

Although specific embodiments and constructions have been disclosed herein, it is to be understood that these are for illustrative purposes only. Various modifications and adaptations will be readily apparent to those of skill in the art. Accordingly, the scope of the present invention should be determined by reference to the claims appended hereto.

What is claimed is:

1. An invention comprising a musical instrument pneumatic actuator having:

(a) a plastic upper body piece including a front portion, an offset portion, a valve cover portion with an atmospheric port surrounded by an upper valve seat, said valve cover portion connected to and offset from said front portion by said offset portion, a vacuum chamber enclosing portion connected to said valve cover portion and having a vacuum port surrounded by a lower valve seat, a vacuum hole, and a signal hole;

(b) a valve member with a valve portion and a stem portion, said valve portion disposed between said upper valve seat and said lower valve seat for alternate seating thereon, said stem portion extending through said vacuum port;

(c) a pouch in said vacuum chamber enclosing portion and operable for moving said valve member;

(d) a lower body piece; and (e) a bellows piece attaching said upper body piece to said lower piece for relative pivotable movement therebetween; and wherein said upper body piece is integral such that said upper valve seat and said lower valve seat are integral with each other, and wherein said valve portion has a larger upper surface area than said atmospheric port, said atmospheric port having boundaries which are integral with said upper body piece.

2. The invention of claim 1 wherein said actuator includes a brace extending between said offset portion and said vacuum chamber enclosing portion.

3. The invention of claim 1 wherein said lower body piece includes a recessed upper surface portion immediately adjacent a pivot point end of said lower body piece.

4. The invention of claim 1 wherein said atmospheric port is beveled from a relatively wide top to a narrower bottom.

5. The invention of claim 4 wherein said actuator further includes a vacuum tube integral with said upper body piece and with an interior having said vacuum hole.

6. The invention of claim 1 wherein said bellows seals two sides of said vacuum chamber enclosing portion.

7. The invention of claim 1 further comprising a plurality of said actuators operably connected to a musical instrument.

8. The invention of claim 7 wherein said musical instrument is a player piano.

9. An invention comprising a musical instrument pneumatic actuator having:

(a) a plastic upper body piece including a front portion, an offset portion, a valve cover portion with an atmospheric port surrounded by an upper valve seat, said valve cover portion connected to and offset from said front portion by said offset portion, a vacuum chamber enclosing portion connected to said valve cover portion and having a vacuum port surrounded by a lower valve seat, a vacuum hole, and a signal hole, and a brace extending between said offset portion and said vacuum chamber enclosing portion;

(b) a valve member with a valve portion and a stem portion, said valve portion disposed between said upper valve seat and said lower valve seat for alternate seating thereon, said stem portion extending through said vacuum port;

(c) a pouch in said vacuum chamber enclosing portion and operable for moving said valve member;

(d) a lower body piece; and (e) a bellows piece attaching said upper body piece to said lower piece for relative pivotable movement therebetween.

10. The invention of claim 9 wherein said bellows seals two sides of said vacuum enclosing portion.

11. The invention of claim 10 wherein said upper body piece is integral such that said upper valve seat and said lower valve seat are integral with each other, and wherein said valve portion has a larger upper surface area than said atmospheric port, said atmospheric port having boundaries which are integral with said upper body piece.

12. The invention of claim 11 wherein said lower body piece includes a recessed upper surface portion immediately adjacent a pivot point end of said lower body piece.

13. The invention of claim 11 wherein said atmospheric port is beveled from a relatively wide top to a narrower bottom and wherein said actuator further includes a vacuum tube integral with said upper body piece with an interior having said vacuum hole.

14. The invention of claim 13 further comprising a plurality of said actuators operably connected to a musical instrument and wherein said musical instrument is a player piano.

15. An invention comprising a musical instrument pneumatic actuator having:

(a) a plastic upper body piece including a front portion, an offset portion, a valve cover portion with an atmospheric port surrounded by an upper valve seat, said valve cover portion connected to and offset from said front portion by said offset portion, a vacuum chamber enclosing portion connected to said valve cover portion and having a vacuum port surrounded by a lower valve seat, a vacuum hole, and a signal hole;

(b) a valve member with a valve portion and a stem portion, said valve portion disposed between said upper valve seat and said lower valve seat for alternate seating thereon, said stem portion extending through said vacuum port;

(c) a pouch in said vacuum chamber enclosing portion and operable for moving said valve member;

(d) a lower body piece; and (e) a bellows piece attaching said upper body piece to said lower piece for relative pivotable movement therebetween; and wherein said lower body piece includes a recessed upper surface portion immediately adjacent a pivot point end of said lower body piece and operable to receive portions of said bellows piece when said bellows compresses.

16. The invention of claim 15 wherein said actuator includes a brace extending between said offset portion and said vacuum chamber enclosing portion and wherein said upper body piece is integral such that said upper valve seat and said lower valve seat are integral with each other, and wherein said valve portion has a larger upper surface area than said atmospheric port, said atmospheric port being boundaries which are integral with said upper body piece.

17. The invention of claim 16 wherein said actuator further includes a vacuum tube integral with said upper body piece with an interior having said vacuum hole.

18. An invention comprising a musical instrument pneumatic actuator having:

(a) a plastic upper body piece including a front portion, an offset portion, a valve cover portion with an atmospheric port surrounded by an upper valve seat, said valve cover portion connected to and offset from said front portion by said offset portion, a vacuum chamber enclosing portion connected to said valve cover portion and having a vacuum port surrounded by a lower valve seat, a vacuum hole, and a signal hole; (b) a valve member with a valve portion and a stem portion, said valve portion disposed between said upper valve seat and said lower valve seat for alternate seating thereon, said stem portion extending through said vacuum port; (c) a pouch in said vacuum chamber enclosing portion and operable for moving said valve member; (d) a lower body piece; and (e) a bellows piece attaching said upper body piece to said lower piece for relative pivotable movement therebetween; and wherein said actuator further includes a vacuum tube integral with said upper body piece with an interior having said vacuum hole.

19. The invention of claim 18 wherein said actuator includes a brace extending between said offset portion and said vacuum chamber enclosing portion, and wherein said upper body piece is integral such that said upper valve seat and said lower valve seat are integral with each other, and wherein said valve portion has a larger upper surface area than said atmospheric port, said atmospheric port having boundaries which are integral with said upper body piece.

20. The invention of claim 18 wherein said lower body piece includes a recessed upper surface portion immediately adjacent a pivot point end of said lower body piece.

21. The invention of claim 18 wherein said lower body piece is plastic and said bellows piece is bonded into the plastic upper and lower body pieces by hardening of the plastic itself.

* * * * *